United States Patent [19]

Hayashi et al.

[11] Patent Number: 4,716,620

[45] Date of Patent: Jan. 5, 1988

[54] VACUUM CLEANER

[75] Inventors: Seizo Hayashi, Oumi Hachiman; Hidenori Kitamura, Youkaichi; Yuichi Shimizu, Oumi Hachiman, all of Japan

[73] Assignee: Matsushita Electric Industrial Co., Ltd., Osaka, Japan

[21] Appl. No.: 4,398

[22] Filed: Jan. 20, 1987

[30] Foreign Application Priority Data

Jan. 17, 1986 [JP] Japan ..... 61-5503[U]
Jan. 20, 1986 [JP] Japan ..... 61-6102[U]

[51] Int. Cl.[4] ..... A47L 5/36
[52] U.S. Cl. ..... 15/327 F; 15/327 E
[58] Field of Search ..... 15/327 R, 327 F, 327 E, 15/377

[56] References Cited

U.S. PATENT DOCUMENTS 2,155,669 4/1939 Lofgren .
2,438,133 3/1948 Sparklin ..... 15/327 F X
2,699,838 1/1955 Holm-Hansen .
3,199,137 8/1965 Segesman ..... 15/327 F X
3,375,541 4/1968 Fromknecht ..... 15/327 F
4,554,700 11/1985 Lyman ..... 15/327 F X
4,597,130 7/1986 Lyman ..... 15/377 X

FOREIGN PATENT DOCUMENTS 7511720 7/1975 Fed. Rep. of Germany .

*Primary Examiner*—Chris K. Moore
*Attorney, Agent, or Firm*—Pollock, VandeSande & Priddy

[57] ABSTRACT

A vacuum cleaner includes a cleaner housing accommodating a motor-driven air blower and having a dust collection chamber defined in a front end thereof. An upper cover is detachably hinged at an end to the cleaner housing for closing an upper portion of the dust collection chamber and has a slanted surface inclined downwardly toward the front end. The upper cover has an inlet hole defined in the slanted surface for communication with the dust collection chamber when the upper portion of the dust collection chamber is closed by the upper cover. A connector pipe connected at one end to an intake hose has an opposite end rotatably coupled to the inlet hole. The connector pipe is bent at such an angle as to be directed substantially vertically when the hose is directed upwardly.

10 Claims, 16 Drawing Figures

VACUUM CLEANER

BACKGROUND OF THE INVENTION

The present invention relates to a vacuum cleaner having an intake tube or hose connector rotatably coupled to an upper cover that covers an upper portion of a dust collection chamber.

FIGS. 15 and 16 of the accompanying drawings show a conventional vacuum cleaner having a cleaner housing 1 including an upper cover 2. An intake tube or hose 3 connected at one end to a suction nozzle (not shown) is fixed to a connector pipe 4 inserted in the upper cover 2 so as to be rotatable about an axis 5 normal to the upper cover 2. The connector pipe 4 has a joint end 6 joined to the hose 3.

When the hose 3 is pulled upwardly in the direction of the arrow A (FIG. 15) or the cleaner housing 1 is erected on a stairstep (FIG. 16) during use of the vacuum cleaner, the hose 3 is forcibly bent at the joint end 6 of the connector pipe 4. Repeated use of the vacuum cleaner in the position of FIG. 15 or 16 causes the hose 3 to be torn or cut off.

As shown in FIGS. 15 and 16, the hose 3 is bent substantially perpendicularly to the connector pipe 4, which itself has a substantially right-angled bend joined to the upper cover 2. Therefore, an air flow passing through the hose 3 and the connector pipe 4 is subjected to a substantial resistance that lowers the performance of the vacuum cleaner. Furthermore, dust drawn into the hose 3 tends to be deposited in these bent portions, resulting in the formation of dust clogs therein.

When a place such as a ceiling or shelf positioned upwardly of the vacuum cleaner is to be cleaned while the cleaner housing 1 is being placed as shown in FIG. 15, the substantially horizontal portion of the connector pipe 4 and the bent portion of the hose 3, which are collectively indicated by A, become an obstacle that reduces the upward reach of the hose 3. This may prevent the suction nozzle on the upper end of the hose 3 from reaching the ceiling or shelf desired to be cleaned. In order to allow the suction nozzle to reach the desired place, the length of the hose 3 has to be increased.

Moreover, while such an upper place is being cleaned, forces tending to pull the cleaner housing 1 upwardly are applied since the hose 3 leads via the sharp bend from the joint end 6 of the connector pipe 4. To avoid such upward forces, the user has to erect or lift the cleaner housing 1. Thus, the cleaning of such an upper place is quite laborious.

SUMMARY OF THE INVENTION

In view of the aforesaid drawbacks of the conventional vacuum cleaner, it is an object of the present invention to provide a vacuum cleaner which can be used highly efficiently and conveniently.

To achieve the above object, a vacuum cleaner according to the present invention has a cleaner housing including an upper cover having a slanted surface inclined progressively downwardly toward a front end of the cleaner housing. The slanted surface of the upper cover has an inlet hole. A connector pipe coupled to an intake tube or hose is rotatably joined to the inlet hole of the upper cover, the connector pipe being bent at a certain angle.

Since the hose can easily be directed upwardly by the user, the vacuum cleaner is not required to be erected or lifted by the user when cleaning a place above the vacuum cleaner. Consequently, the place which is positioned upwardly of and can be cleaned by the vacuum cleaner is widened. The hose is prevented from being torn and no dust is clogged in the hose because the hose has no sharp bend, resulting in increased performance of the vacuum cleaner.

BRIEF DESCRIPTION OF THE DRAWINGS

The present invention will be described in detail by way of illustrative example with reference to the accompanying drawings, in which.

DETAILED DESCRIPTION

Figure 1:
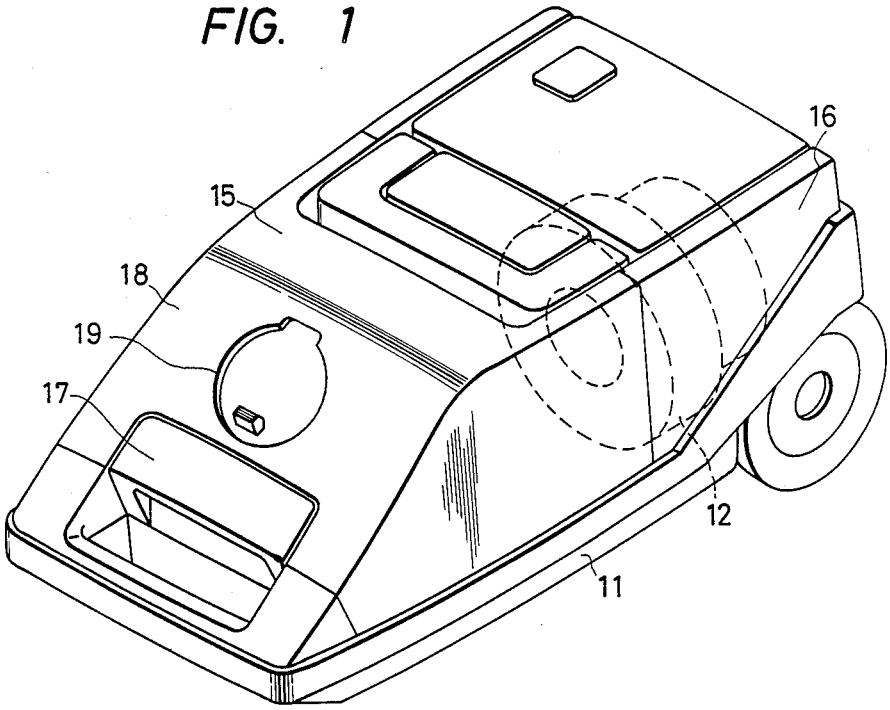
FIG. 1 is a perspective view of a vacuum cleaner according to an embodiment of the present invention.

Like or corresponding parts are denoted by like or corresponding reference numerals throughout several views.

FIGS. 1 through 5 show a vacuum cleaner according to an embodiment of the present invention. As better shown in FIG. 2, the vacuum cleaner includes a cleaner housing 11 in which a motor-driven air blower 12, a cord reel 9, and other components are accommodated. The cleaner housing 11 has a dust collection chamber 14 defined in a front end portion (shown on the lefthand side of FIG. 2) thereof and placing therein a dust collection bag 13 such as a paper bag. The dust collection chamber 14 is closed at its upper portion by an upper cover 15 with its rear edge detachably hinged to a housing cover 16. The front edge of the upper cover 15 is detachably clamped on the cleaner housing 11 by means of a buckle 17.

The upper cover 15 has a front slanted surface 18 progressively inclined downwardly toward the front end of the cleaner housing 11. The slanted surface 18 has an inlet hole 19 defined substantially centrally therein. A sleeve 21 is rotatably disposed between the upper cover 15 and a cover stiffening plate 20 attached to and positioned below the upper cover 15.

Figure 3:
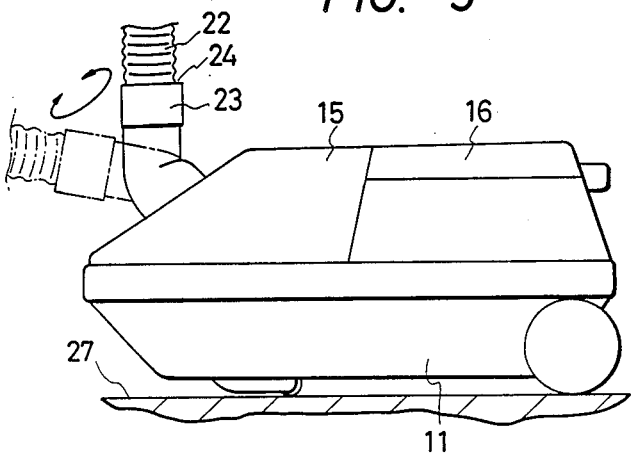
FIG. 3 is a side elevational view of the vacuum cleaner, showing the manner in which a connector pipe is rotated.

As shown in FIG. 3, an intake tube or hose 22 is connected at a lower end thereof to a substantially J-shaped connector pipe 23. The connector pipe 23 has a lower end inserted into the inlet hole 19 substantially perpendicularly to the slanted surface 18 and detachably secured to the rotatable sleeve 21 in airtight relationship. The lower end of the hose 22 is joined to the connector pipe 23 at its joint end 24.

Figure 4:
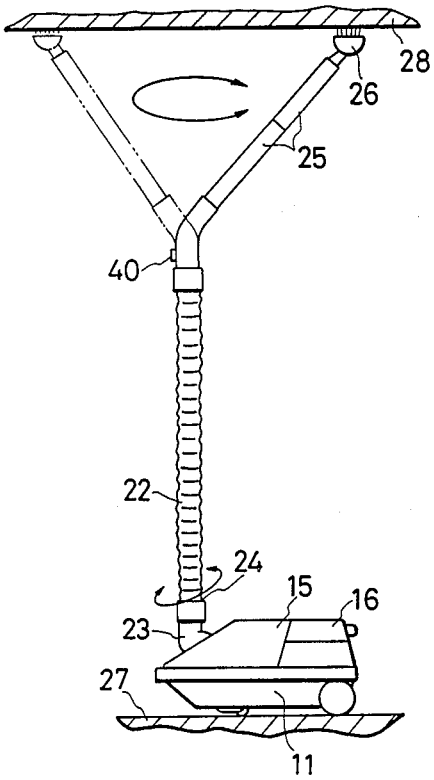
FIG. 4 is a side elevational view showing the manner in which a ceiling is cleaned by the vacuum cleaner.
Figure 5:
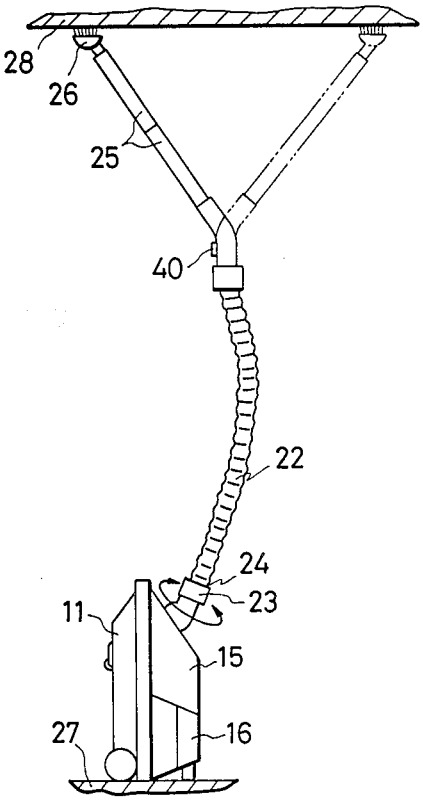
FIG. 5 is a side elevational view showing the manner in which a ceiling is cleaned by the vacuum cleaner that is erected.

As illustrated in FIGS. 4 and 5, the upper end of the hose 22 is coupled to an extension tube 25 to which a suction nozzle 26 is attached.

Operation of the vacuum cleaner will be described with reference to FIGS. 3 through 5. When a horizontal floor 27 is cleaned by the vacuum cleaner, the hose 22 and the connector pipe 23 are directed substantially horizontally as indicated by the dot-and-dash lines in FIG. 3. When a shelf or a horizontal ceiling 28 (FIG. 4) above the vacuum cleaner is to be cleaned, the connector pipe 23 is rotated with the sleeve 21 and directed in a direction normal to the floor 27. Therefore, the hose 22 can be pulled upwardly without being subjected to undue stresses at the joint end 24 of the connector pipe 23. Since the joint end 24 is brought to a relatively high position, the hose 22 is not required to be of an increased length and the cleaner housing 11 is not required to be erected when cleaning the ceiling 28 as shown in FIG. 4. The connector pipe 23 can be rotated without having to move the cleaner housing 11, so that the ceiling 28 or other places above the vacuum cleaner can be cleaned over a relatively wide area.

FIG. 5 shows the manner in which the vacuum cleaner 11 is erected or put on its rear end for cleaning a higher place. In the position of FIG. 5, the connector pipe 23 can be rotated with ease for cleaning a wide area.

If the upward reach of the hose 22 remains the same as that of the hose of the conventional vacuum cleaner, then the hose 22 may be of a reduced length inasmuch as the joint end 24 of the connector pipe 23 is in a higher position.

The hose 22 is not torn or otherwise damaged since it is not sharply bent at the joint end 24 irrespective of whether the cleaner housing is in the horizontal position of FIG. 4 or the erected position of FIG. 5. In addition, no dust is clogged in the hose 22. The performance of the vacuum cleaner is not lowered because there is no sharp bend in an air passage from the hose 22 via the connector pipe 23 to the dust collection chamber 14 and hence no substantial or abrupt increase in the resistance to the air flow passing through such air passage.

Figure 6:
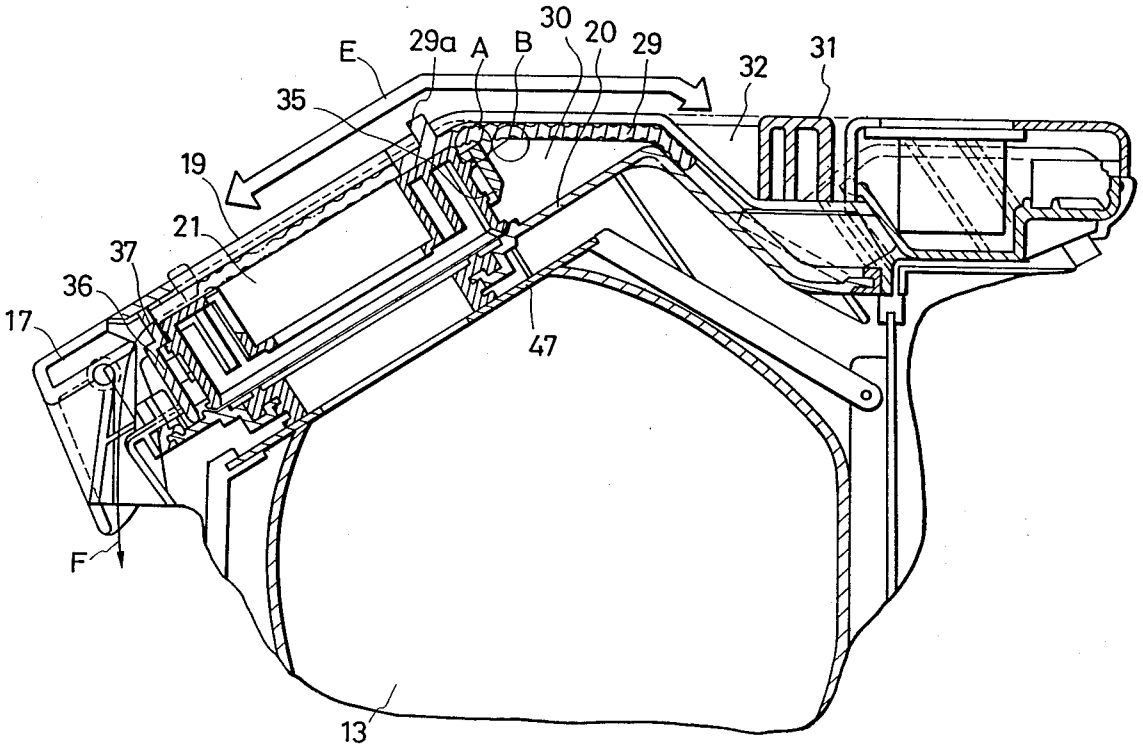
FIG. 6 is an enlarged fragmentary vertical cross-sectional view illustrating an inlet hole according to another embodiment of the present invention.

As shown at an enlarged scale in FIG. 6 which illustrates a vacuum cleaner according to another embodiment of the present invention, a slidable cover 29 is combined with the upper cover 15 for closing the inlet hole 19 after the connector pipe 23 has been removed from the inlet hole 19, the slidable cover 29 having a knob **29*a* on its front end. The slidable cover 29 is made of a resilient resin material such as polypropylene, and has alternate ridges and grooves on its upper and lower surfaces. The slidable cover 29 is supported on a cover bearing rib 30 mounted on the cover stiffening plate 20 when the inlet hole 19 is opened. As the slidable cover 29 is slid by the user gripping the knob 29*a*, the cover 29 is slidably moved over the upper edge of the rotatable sleeve 21 into a position in which the cover 29 closes the inlet hole 19**.

Figure 2:
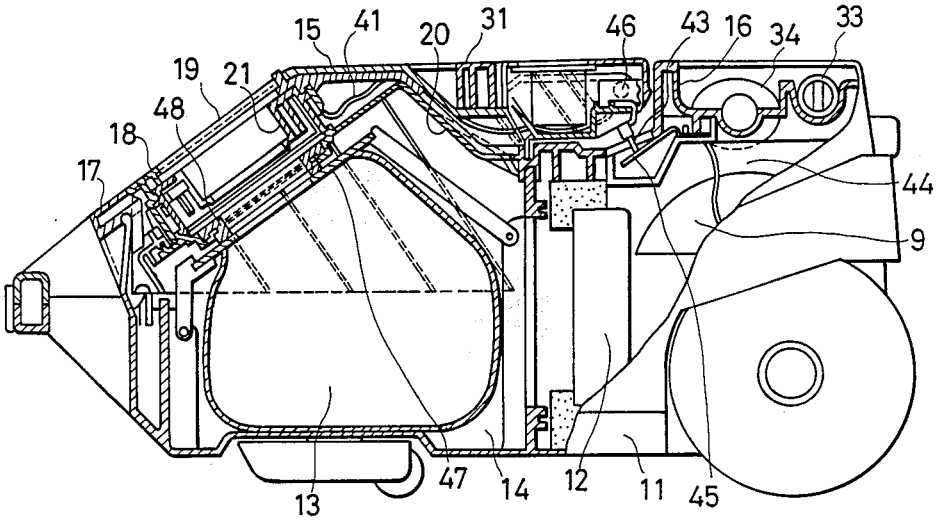
FIG. 2 is a vertical cross-sectional view of the vacuum cleaner shown in FIG. 1.

A handle 31 is mounted on the upper surface of the upper cover 15 at its rear end with a space 32 defined in front of the handle 31 in order to allow the user to grip the handle 31. As illustrated in FIG. 2, a clevis tool 33 and a shelf nozzle 34 are placed on the upper surface of the housing cover 16.

Since the slidable cover 29 is resilient, it can be flexed in its plane and hence can be slid in the direction of the arrow E (FIGS. 6 and 7) even if the upper cover 15 is bent. Therefore, the upper cover 15 is not required to have a large flat surface for supporting the slidable cover 29, with the result that the upper cover 15 is reduced in size.

The upper surface of the upper cover 15 has conventionally been needed to be a large flat surface for accommodating the cover 29, and has failed to support various parts. With the embodiment of the present invention, however, the upper cover 15 can be flexed thereby to allow the handle 31 and the space 32 to be provided on the upper cover 15, in addition to the clevis tool 33 and the shelf nozzle 34 on the housing cover 16.

When the inlet hole 19 is opened and closed by the slidable cover 29, the ridges on the upper and lower surfaces thereof are brought into light contact with a portion A of a support rib 35 and a portion B of the cover bearing rib 30 as shown in FIG. 6, causing vibration of the cover 29 and other components in the housing 11. Therefore, dust and the like that has entered through the inlet hole 19 drops due to such vibration into the paper bag 13 substantially without being trapped by and deposited in the sleeve 21. The sleeve 21 is thus permitted to rotate smoothly and remains highly durable without impairing the ease with which the connector pipe 23 and the hose 22 are operated. The vibration caused when the slidable cover 29 is opened and closed makes the paper bag 13 highly effective to filter dust. As a result, the paper bag 13 can be used and performance of the vacuum cleaner remains at a desired level for a long period of time.

Figure 7:
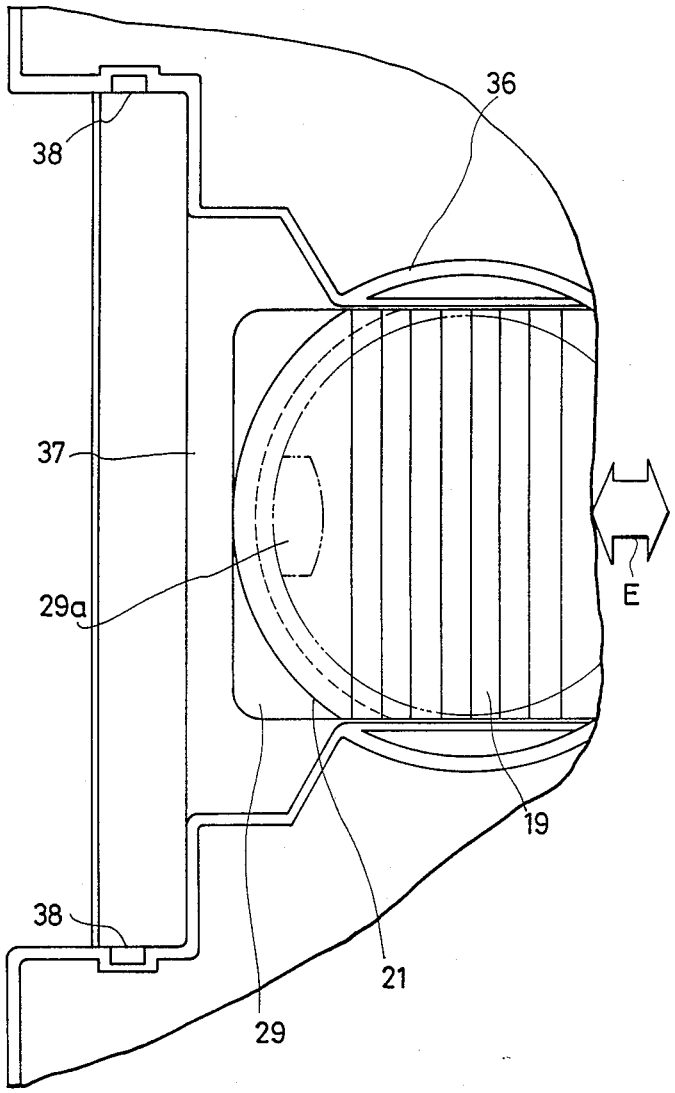
FIG. 7 is an enlarged fragmentary plan view of the inlet hole of FIG. 6.
Figure 8:
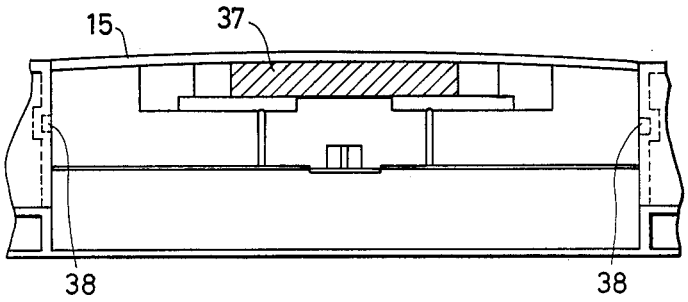
FIG. 8 is a fragmentary front elevational view of the inlet hole of FIG. 6 with a buckle omitted from illustration.

Another embodiment of the present invention will be described with reference to FIGS. 6 through 8. A hole 37 is defined in a support rib 36 in front of the inlet hole 19 which is closed by the slidable cover 39, the hole 37 leading from the inlet hole 19 toward the buckle 17 or the exterior of the cleaner housing 11. The buckle 17 has on its opposite ends pins 38 supported on the cleaner housing 11.

When the connector pipe 23 is detached from the upper cover 15, dust particles that have remained in the connector pipe 23 and the hose 22 enters into the upper cover 15 through the inlet hole 19, and some of these dust particles are deposited on the upper edge of the rotatable sleeve 21. As the slidable cover 29 is flexibly moved over the sleeve 21 in the direction to close the inlet hole 19, the cover 29 pushes the dust deposit off the upper edge of the sleeve 21. Continued closing movement of the cover 29 forces the dust deposit off the sleeve 21 through the hole 37 past the buckle 17 as indicated by the arrow F in FIG. 6. Consequently, dust particles are not deposited on the inner peripheral surface of the support rib 36 against which the sleeve 21 is rotatable and also on the inner surface of the cover stiffening plate 20, so that the sleeve 21 can smoothly be rotated. The dust particles discharged from the hole 37 do not adversely affect rotation of the buckle 17 since they are not directed from the hole 37 to the pins 38 (FIG. 8).

Inasmuch as the sleeve 21 remains smoothly rotatable, as described above, the connector pipe 23 also remains smoothly rotatable for increased convenience of use and durability of the hose 22.

Figure 9:
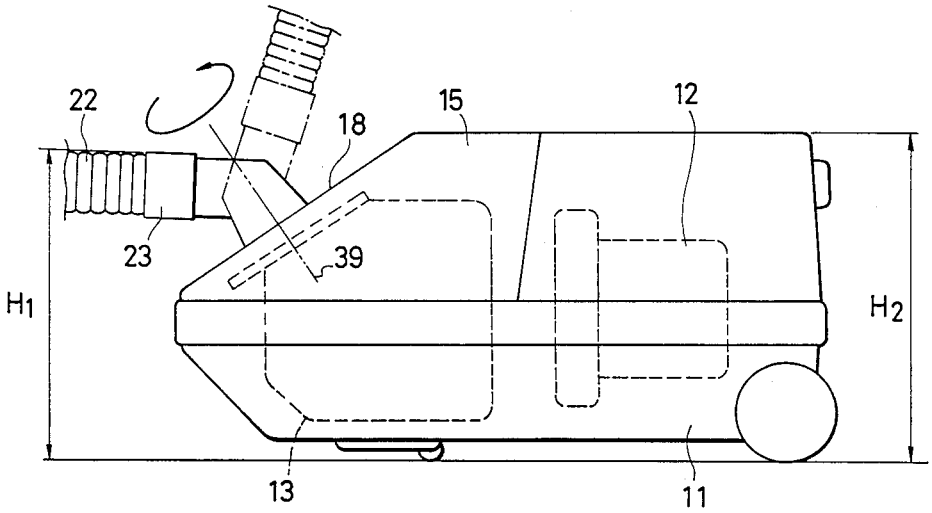
FIG. 9 is a side elevational view of a vacuum cleaner according to still another embodiment of the present invention.
Figure 10:
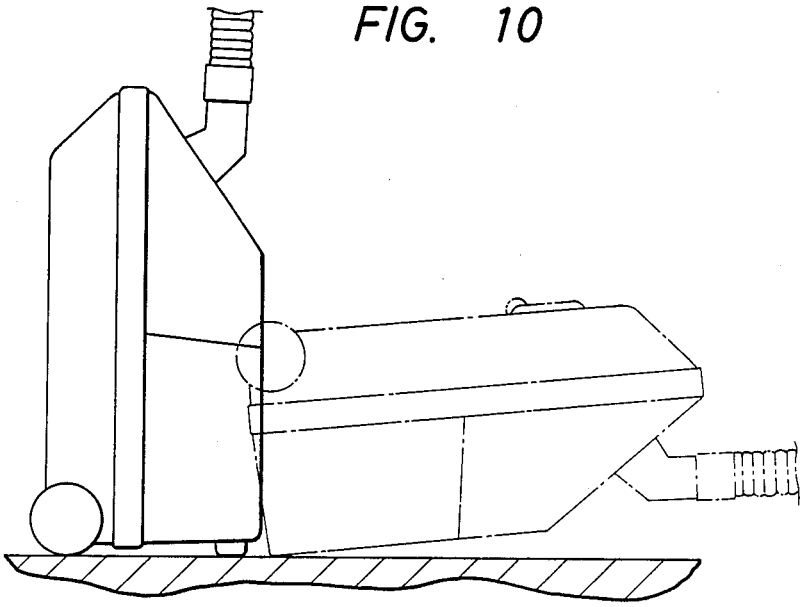
FIGS. 10 and 11 are side elevational views illustrating different modes of use of the vacuum cleaner of FIG. 9.
Figure 11:
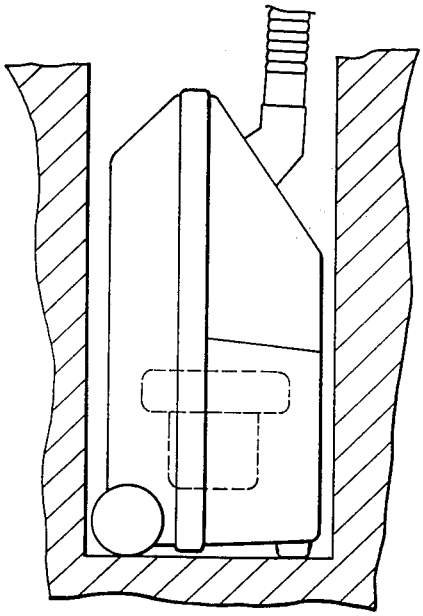

FIGS. 9 through 11 shows a vacuum cleaner according to still another embodiment of the present invention. The slanted surface 18 of the upper cover 15 to which the hose 22 is coupled is inclined at an angle ranging from 30 to 60 degrees with respect to the floor or the horizontal portion of the upper cover 15. With the connector pipe 23 coupled, the maximum height H1 of the connector pipe 23 is equal to or smaller than the maximum height H2 of the cleaner housing ($H1 \leqq H2$).

The vacuum cleaner of FIGS. 9 through 11 operates as follows: The connector pipe 23 is connected to the slanted surface 18 of the upper cover 18. Since the hose 22 is rotatable about an axis 39 normal to the slanted surface 18 and the connector pipe 23 is of such a height as described above with respect to the cleaner housing, the hose 22 and the connector pipe 23 are prevented from hitting the floor and from being damaged, but only the upper cover 15 or the cleaner housing hits the floor, as shown in FIG. 10, even when the cleaner housing is turned over by excessively pulling the hose 22 in order to clean a ceiling or a shelf above the vacuum cleaner.

On account of the dimensional relationship $H1 \leqq H2$, the cleaner housing can be stored in an erected condition with the hose 22 connected thereto, as shown in FIG. 11. This allows the vacuum cleaner to be available for immediate use in a next cleaning process. The vacuum cleaner can be stored in a smaller space as it can be erected.

Figure 12:
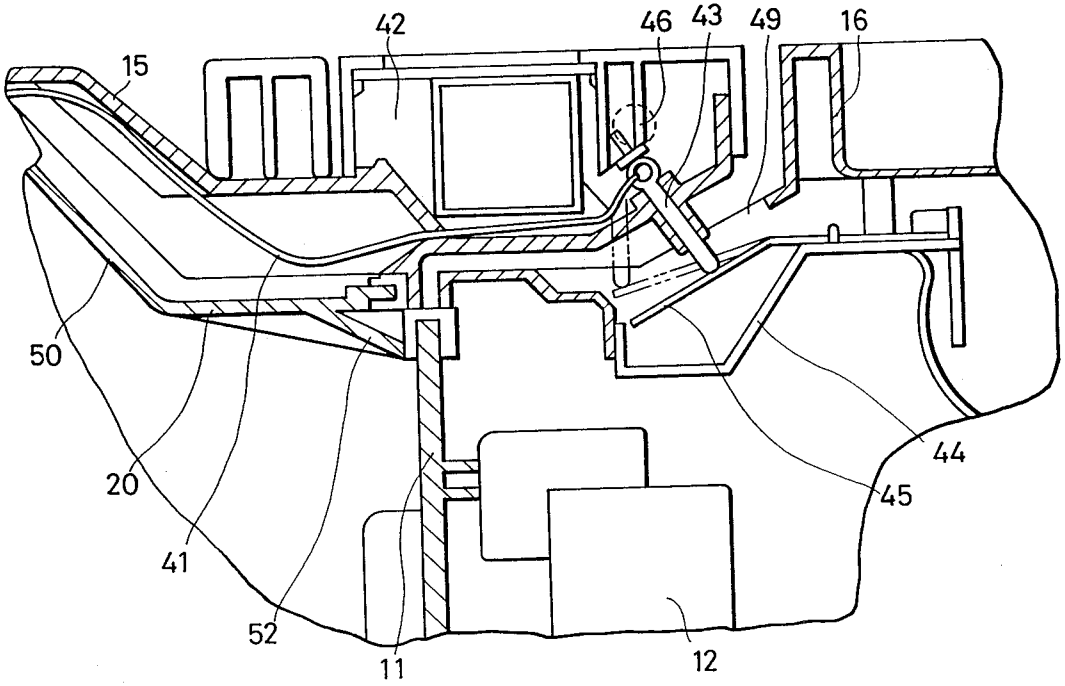
FIG. 12 is an enlarged fragmentary cross-sectional view of an upper cover according to a still further embodiment of the present invention.
Figure 13:
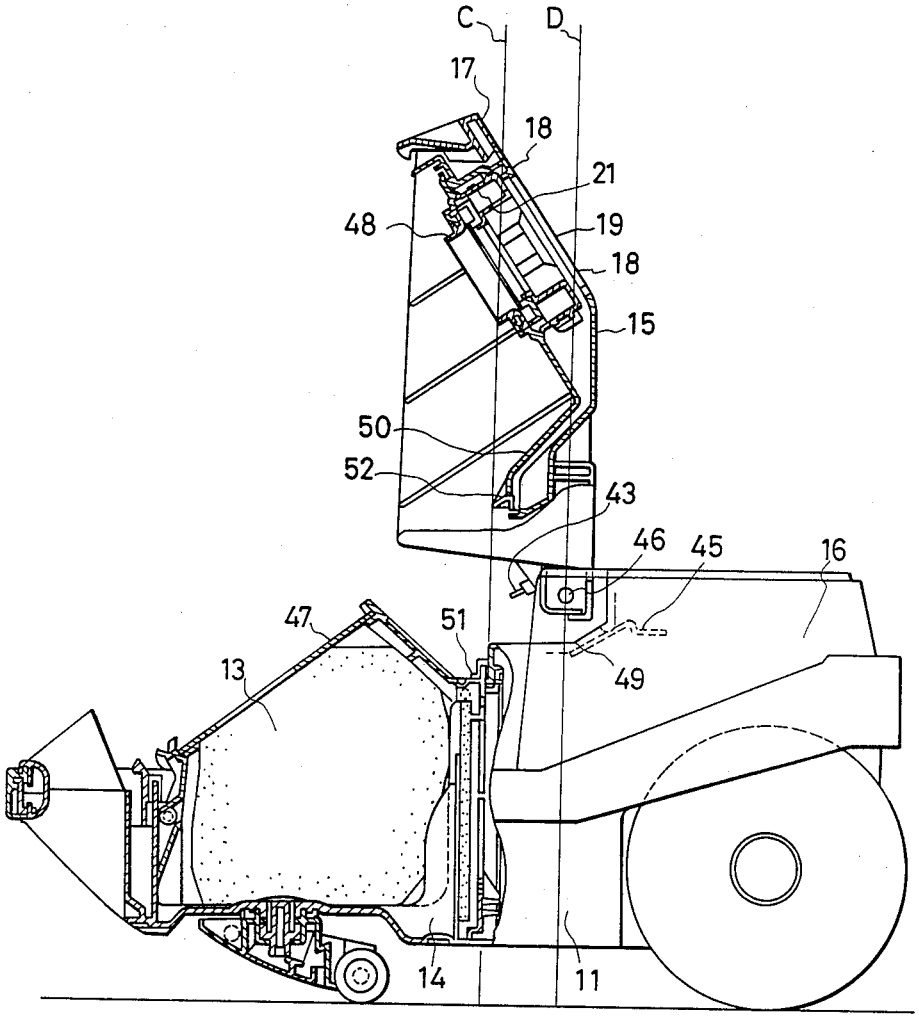
FIG. 13 is a vertical cross-sectional view of a cleaner housing of the vacuum cleaner shown in FIG. 12, with an upper cover opened.
Figure 14:
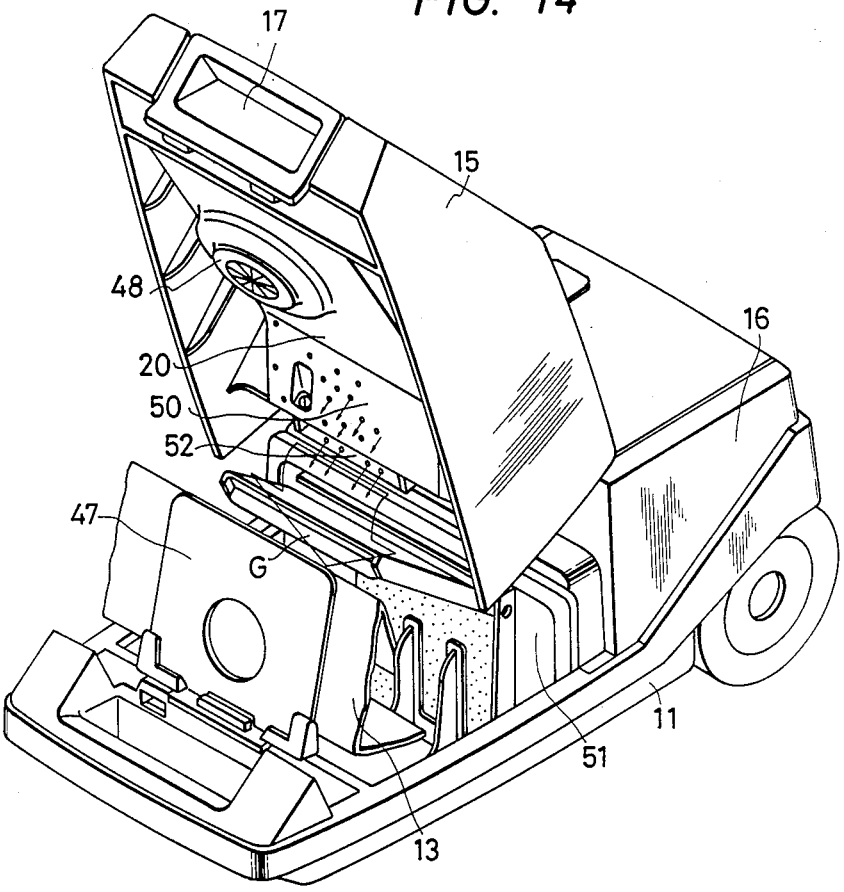
FIG. 14 is a perspective view of the vacuum cleaner shown in FIG. 13.
Figure 15:
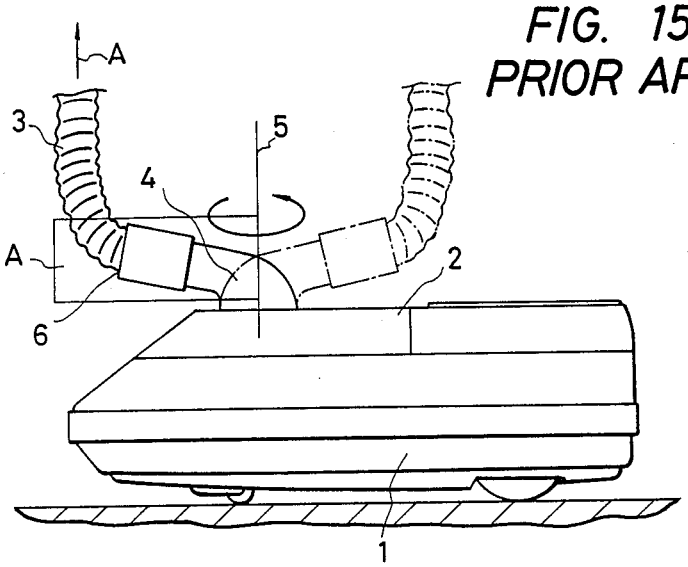
FIG. 15 PRIOR ART
FIGS. 15 and 16 are side elevational views of a conventional vacuum cleaner.
Figure 16:
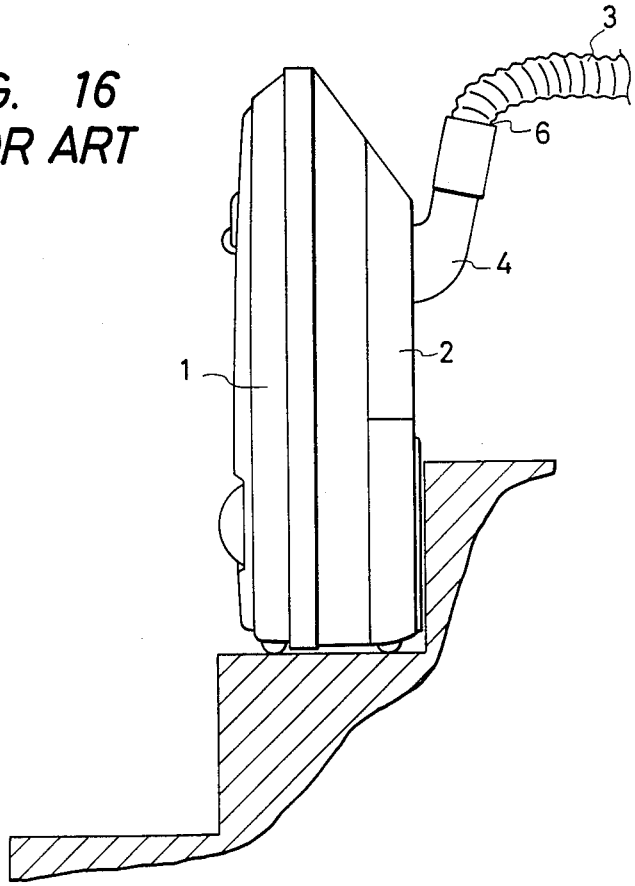
FIG. 16 PRIOR ART

According to a still further embodiment shown in FIGS. 12 through 14, a lead wire 41 lies in the upper cover 15 and extends through the hose 22, the connector pipe 23, and the rotatable sleeve 21 for electric connection between a manual operation switch 40 (FIGS. 4 and 5) and the motor-driven air blower 12 and the cord reel 9. The lead wire 41 passes through the space between the upper cover 15 and the cover stiffening plate 20, enters an indicator chamber 42 defined behind the upper cover 15, and is connected to a terminal 43. A contact spring 45 is mounted on a cord reel partition 44 by which the cord reel 9 is rotatably supported and which is fixed to the cleaner housing 11, the contact spring 45 being disposed in contact with the terminal 43. A lead wire leading from the contact spring 45 is connected to the motor-driven air blower 12 and the cord reel 9.

When the upper cover 15 is closed, the terminal 43 is pressed against the contact spring 45 as shown in FIG. 12. Upon lifting the upper cover 15 with the buckle 17 unlocked, the upper cover 15 is angularly moved upwardly about a cover hinge boss 46 to the position of FIG. 13 in which the terminal 43 is electrically disconnected from the contact spring 45.

A gasket 48 (FIG. 13) is attached to the cover stiffening plate 20 below the inlet hole 19 to connect the inlet hole 19 and an inlet plate 47 of the paper bag 13 in airtight relationship. The housing cover 16 has a hole 49 (FIG. 12) through which the terminal 43 can contact the contact spring 45.

When the upper cover 15 is opened by the user for replacing the paper bag 13, the upper cover 15 is turned about the cover hinge boss 46 to the position of FIG. 13. At this time, some of dust particles introduced through the hose 22 and the connector pipe 23 may remain in the inlet hole 19 without entering the paper bag 13, and will fall down when the upper cover 15 is opened. With the arrangement shown in FIG. 13, a vertical line C passing through the lowermost end of the gasket 48 at the time the upper cover 15 is opened is positioned considerably forwardly of a vertical line D passing through the center of the cover hinge boss 46 since the inlet hole 19 is defined in the slanted surface 18 of the upper cover 15. Accordingly, the dust particles that have fallen from the gasket 48 drop into the paper bag 13 without going to the hinged end of the upper cover 15 when it is opened. As a result, the upper cover 15 remains smoothly openable and closable for a long period of time.

Electric connection between the terminal 43 and the contact spring 45 is also ensured for a long period of time because no dust particle is directed toward the terminal 43 and the contact spring 45 since they are positioned behind the vertical line C. The hole 49 for allowing the terminal 43 and the contact spring 45 to be electrically contacted therethrough is also positioned behind the vertical line C. Dust particles are thus prevented from finding their way through the hole 49 into the cleaner housing 11. Rotation of the motor-driven air blower 12 is not adversely affected by dust or other foreign matter which would otherwise enter through the hole 49. Therefore, the motor-driven air blower 12 remains highly durable.

As described above, electric connection between the upper cover and the cleaner housing can reliably be made for increased durability of the vacuum cleaner, and the durability of the motor-driven air blower is also increased. Moreover, the upper cover remains smoothly openable and closable with increased durability.

As shown in FIGS. 13 and 14, the cover stiffening plate 20 has a slanted surface 50 positioned behind the gasket 48, the slanted surface 50 being inclined forwardly and downwardly when the upper cover 15 is turned upwardly to open the dust collection chamber 14. A vertical partition 51 is disposed between the motor-driven air blower 12 and the dust collection chamber 14. A rib is integrally formed with the cover stiffening plate 20 for holding the partition 51 downwardly when the upper cover 15 is closed, in order to protect the partition 51 from deformation which would otherwise arise from a temperature rise of the motor-driven air blower 12. The rib has a slanted surface 52 facing toward the dust collection chamber 14.

When the upper cover 14 is opened by the user for replacing the paper bag 13, the upper cover 14 is turned about the cover hinge boss 46 to the position of FIGS. 13 and 14, and dust particles falling from the inlet hole 19 through the gasket 48 are guided by the slanted surfaces 50, 523 into the dust collection chamber 14 as indicated by the arrow G in FIG. 14, but are not directed toward the cover hinge boss 46, which therefore allows the upper cover 15 to be smoothly rotatable.

Electric connection between the terminal 43 and the contact spring 45 is also kept for a long period of time since the terminal 43 and the contact spring 45 are positioned behind the slanted surfaces 50, 52 and hence no dust is deposited on the terminal 43 and the contact spring 45. The hole 49 is also positioned behind the slanted surfaces 50, 52 to prevent dust particles from dropping through the hole 49 into the cleaner housing 11, with the result that the motor-driven air blower 12 will remain highly durable.

Although certain preferred embodiments of the present invention have been shown and described in detail, it should be understood that various changes and modifications may be made therein without departing from the scope of the appended claims.

We claim:

1. A vacuum cleaner comprising:

a cleaner housing accommodating a motor-driven air blower and having a dust collection chamber defined in a front end thereof;

an upper cover detachably hinged at an end to said cleaner housing for closing an upper portion of said dust collection chamber and having a slanted surface inclined downwardly toward said front end, said upper cover having an inlet hole defined in said slanted surface for communication with said dust collection chamber when the upper portion of said dust collection chamber is closed by said upper cover; and a connector pipe connected at one end to an intake hose and having an opposite end rotatably coupled to said inlet hole, said connector pipe being bent at such an angle as to be directed substantially vertically when said hose is directed upwardly.

2. A vacuum cleaner according to claim 1, wherein said connector pipe remains below an upper surface of said cleaner housing when the connector pipe is turned forwardly toward said front end.

3. A vacuum cleaner according to claim 1, wherein said cleaner housing has a rear end opposite to said front end and arranged such that the cleaner housing can be erected on said rear end.

4. A vacuum cleaner according to claim 1, further including a slidable cover mounted in said upper cover for opening and closing said inlet hole.

5. A vacuum cleaner according to claim 4, wherein said slidable cover is made of a resilient resin material and has ridges and grooves on each of upper and lower surfaces thereof.

6. A vacuum cleaner according to claim 5, wherein said upper cover has means for guiding said slidable cover along a bent plane when opening and closing said inlet hole.

7. A vacuum cleaner according to claim 1, further including a sleeve rotatably disposed in said inlet hole, said connector pipe being detachably mounted in said sleeve.

8. A vacuum cleaner according to claim 1, wherein said inlet hole is positioned forwardly of said hinged end of said upper cover when said upper cover is turned to open the upper portion of said dust collection chamber.

9. A vacuum cleaner according to claim 1, wherein said upper cover has another slanted surface disposed below said inlet hole and inclined downwardly toward said front end when said upper cover is turned to open the upper portion of said dust collection chamber.

10. A vacuum cleaner according to claim 1, wherein said connector pipe is substantially J-shaped.

* * * * *